US006308435B1

(12) United States Patent
Arcaini et al.

(10) Patent No.: US 6,308,435 B1
(45) Date of Patent: Oct. 30, 2001

(54) PROCESS AND FACILITY FOR PROCESSING MUNICIPAL WASTE COMBUSTION ASH

(75) Inventors: Gianni B. Arcaini, Jacksonville; Larry Strach, Ponte Vedra, both of FL (US); Nicholas Bruno, Red Lion, PA (US)

(73) Assignee: DUOS Engineering (USA), Inc., Jacksonville, FL (US)

( * ) Notice: Subject to any disclaimer, the term of this patent is extended or adjusted under 35 U.S.C. 154(b) by 0 days.

(21) Appl. No.: 09/499,120

(22) Filed: Feb. 7, 2000

(51) Int. Cl.[7] ..... F23G 5/04; F26B 5/00

(52) U.S. Cl. ..... 34/380; 34/381; 210/770; 110/221

(58) Field of Search ..... 34/69, 85, 178, 34/305, 380, 381; 210/770, 799, 802, 248; 110/221

(56) References Cited

U.S. PATENT DOCUMENTS 3,623,438 * 11/1971 Cardinal, Jr. ..... 110/221
4,049,391 * 9/1977 Marsh ..... 44/589
5,536,420 * 7/1996 Oyzboyd ..... 210/804

* cited by examiner

*Primary Examiner*—Gregory Wilson
(74) *Attorney, Agent, or Firm*—Arthur G. Yeager

(57) ABSTRACT

An enclosed drainage facility to dry municipal waste combustion ash has a plurality of spaced elongated channels to drain by gravity, water from piles of ash into a disposal or reclamation pool. The channels are sloping concrete ditches leading to a common trough or pipe to a covered storage basin. Steel plates pierced with a plurality of spaced slender slits abut each other to cover each channel. The atmosphere in the facility is changed by being pumped into one side of the facility and exhausted adjacent an opposite side. Also, a process for drying municipal waste combustion ash includes dewatering and drying of ash piles in an atmosphere of warm dry air for a period of time necessary to reduce the moisture to about 28%.

20 Claims, 3 Drawing Sheets

PROCESS AND FACILITY FOR PROCESSING MUNICIPAL WASTE COMBUSTION ASH

CROSS-REFERENCE TO RELATED APPLICATIONS

Not Applicable

STATEMENT REGARDING FEDERALLY SPONSORED RESEARCH

Not Applicable

BACKGROUND OF THE INVENTION (1) Field of the Invention

This invention relates to the field of treatment and use of municipal waste; and more particularly, it relates to the drying of such waste material after it has been burned in a waste energy facility.

(2) Description of the Related Art

U.S. Pat. No. 5,992,776 issued on Nov. 30, 1999, describes a process for treating municipal waste combustion ash to recover the values of the combustion ash substantially free of unburned debris and metals, especially ferrous metals.

BRIEF SUMMARY OF THE INVENTION

The present invention relates to a process and a facility for treating municipal waste combustion ash having a high moisture content to a drying operation and recovering an ash with a moisture content of not more than about 28%. The process includes draining water from wet masses of the raw ash spread out in rows on a floor in an enclosed dehumidified atmosphere for a time sufficient to reduce the moisture content to not more than about 28%. The enclosed atmosphere may be warmed to about 80–120° F. The facility for undertaking this process includes an underground covered water storage basin with a plurality of parallel drainage channels sloped to drain water by gravity to one side of the facility to a common gutter and thence to a covered storage basin for treatment and/or disposal. Each channel is covered with a removable metal plate having a plurality of spaced drainage slots for directing the drained water into the underground channels. The facility is closed to the atmosphere and equipped with sufficient dehumidification equipment to dry the interior atmosphere to accomplish the necessary drying of the ash in an appropriate time period.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
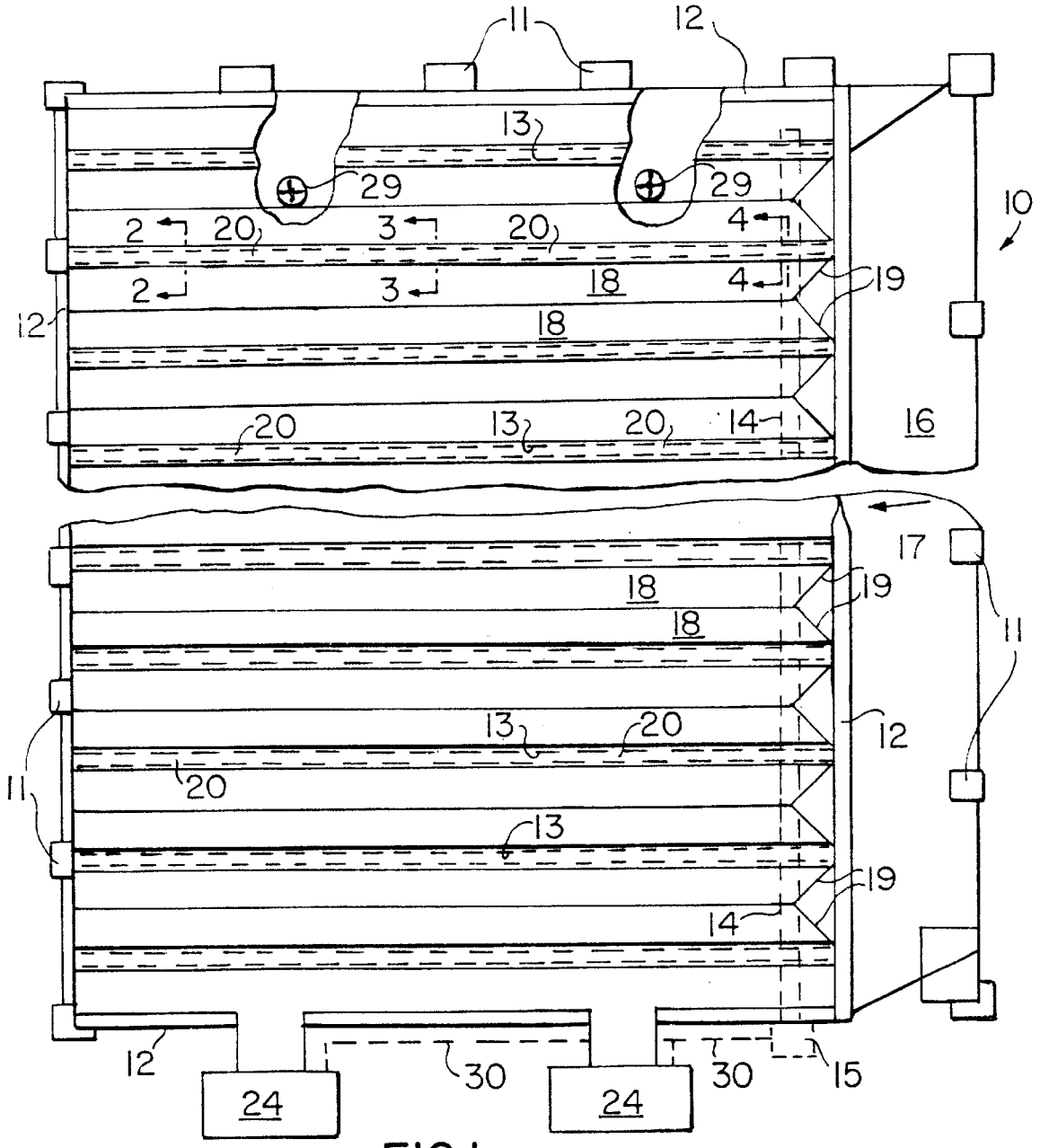
FIG. 1 is a top plan view of the drying enclosure as seen from above.

The invention is directed to an enclosed facility 10 and to a process practiced in that facility for dewatering and drying municipal waste combustion ash so that it may be later processed with care to minimize contamination of the surrounding areas or the atmosphere. Normally the municipal waste is burned in a furnace after removal of large metal objects and chemical containers as feasible, and the resulting material remaining after combustion is removed from the furnace, quenched in a tank of water and piled up to cool prior to being removed to a landfill for disposal or to a recycling facility for processing. Such combustion ash normally has a moisture content of 35–55% by weight. The present invention involves delivery of the combustion ash to a covered and enclosed drainage area where free water from the ash is allowed to drain away by gravity. The ash usually is dumped in piles and is then spread out in rows over a larger area. The dumping area is generally a flat floor surface covering underground drainage channels that lead to a covered storage basin where it is treated as needed prior to discharge to a sanitary sewer. The flat upper surface is gently sloping in different directions so as to lead the drained water to the underground channels for processing and disposal. The atmosphere above the drainage surface is dehumidified to assist in the drying operation. FIG. 1 shows the general overall plan of the drainage building where the combustion ash is dried in accordance with this invention. The building is covered and enclosed so that the dehumidification part of the process may be effective in assisting in the drying of the ash. The building is preferably only one story high with head room high enough to accommodate dump chassis of delivery vehicles and earth-moving front loaders of small to moderate size; e.g., ceiling structures high enough to provide head space of about 35 to 40 ft. The floor area is fashioned with generally parallel drainage channels 13 spaced about 12–15 ft. apart, and each channel 13 is covered with a steel sheet cover 20 having slotted openings 23 therethrough to permit drainage water to pass through, but no large clumps of solid matter. The surrounding surface between channels 13 slope toward each of the adjacent channels so as to collect the drained moisture and conduct it away to disposal. Surfaces 18 slope downwardly to channels 13 which drain into collection trough or gutter 14 which lead to a collection site such as a covered storage basin 15. An appropriate juncture of the sloping surfaces is generally depicted at 19.

Trucks carrying combustion ash, dump their loads on surfaces 16 within the facility which slope gently toward drainage channels 13. After the loads are dumped on surface 16, they may be moved around by front end loaders to any selected location. In any event, the combustion ash is placed on the drainage surface 18 and allowed to drain its moisture into channels 13 where the collected water will drain away to collection channel 14 and thence to covered storage basin 15.

So that the operators know how long the ash has been stored in the enclosed facility 10, it should be large enough to at least accommodate a daily amount of ash in each row, i.e., generally corresponding to the number of drains 13, and this permits the normal first in-first out for further processing. A minimum number of drains 13 accordingly, would be about fifteen and the maximum about twenty-five to assure some overly moist ash a sufficient time to become dewatered as well as some future increases in the amount of ash brought into facility 10.

While the above-described drainage is occurring the air space in the building facility above the ash piles is subjected to dehumidified air by one or more dehumidifiers 24 to maintain a relative humidity of about 10–25%. Water from the dehumidifiers 24 may be discharged or may be added to the covered storage basin 15, as shown by pipe broken lines 30. Roof exhaust fans 29 are located generally at the opposite end of the facility 10 from the location of the dehumidifiers 24 to assure that the air in the facility is distributed throughout for proper drying of the surface portions of the ash piles. While two fans 29 are shown, the number may vary in that such fans should be operative to remove the volume of dehumidified air added to the drying area of facility 10 by dehumidifiers 24. The combination of drainage and dehumidification will in about two weeks dry the combustion ash to a level of about 28% maximum.

Generally, the combustion ash that has been delivered from a waste-to-energy facility is very wet and has variable moisture contents in excess of 35% by weight. The first step in making the ash processable is to dry it out to a uniform moisture. At any moisture content above about 28% the ash tends to clump, adheres and clogs-up processing screens, sticks to conveyors, plugs chutes and hoppers, sticks to ferrous and non-ferrous metals, causes buildup in hammer mills and the like and causes spillage, cleanup chores and down time of the ash processing equipment. Thus, it is important to adjust the moisture content to be no more than 28% so that it may be processed to remove the ferrous and non-ferrous metals and unburned materials and use the processed aggregate for road or other building purposes.

It is well-known that municipal waste combustion ash having its usual history has a moisture content of about 25% to 55%. This ash must be dried to a maximum of 28% moisture to be acceptable for most processing purposes. Storing of raw ash in enclosed places for long periods of time will undoubtedly result in processable dry ash, but it requires very long periods of drying which are not economically acceptable because of the very large building required for storing the ash in a building for some two months or more. The process of this invention will minimize the size of the facility and adequately and economically dry the ash prior to processing same. The time for drying a pile of combustion ash that has withstood the weather of rain and sun in typical cycles may be a matter of several months, if no special treatments are employed. The process of the present invention is capable of transforming raw ash into acceptable processing material in about two weeks and therefore saves one or more months of dewatering treatment time, which is highly profitable to the operators of the ash processing plant.

Figure 2:
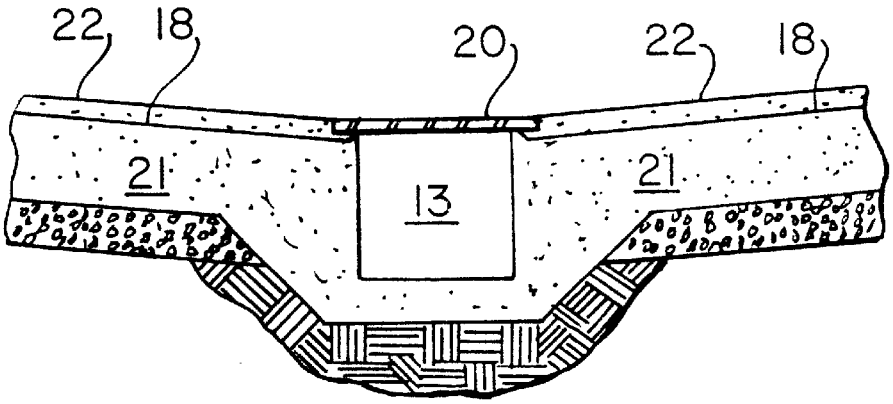
FIG. 2 is a cross-sectional view of one of the drainage channels in the drying enclosure taken at 2—2.
Figure 3:
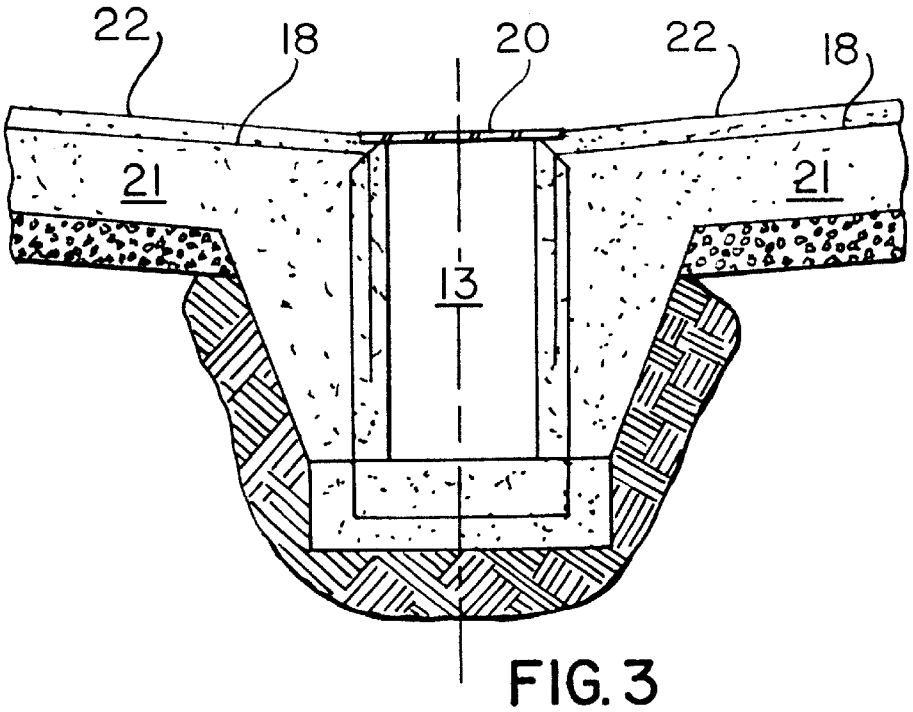
FIG. 3 is a cross-sectional view of one of the drainage channels in the drying enclosure taken at 3—3.
Figure 4:
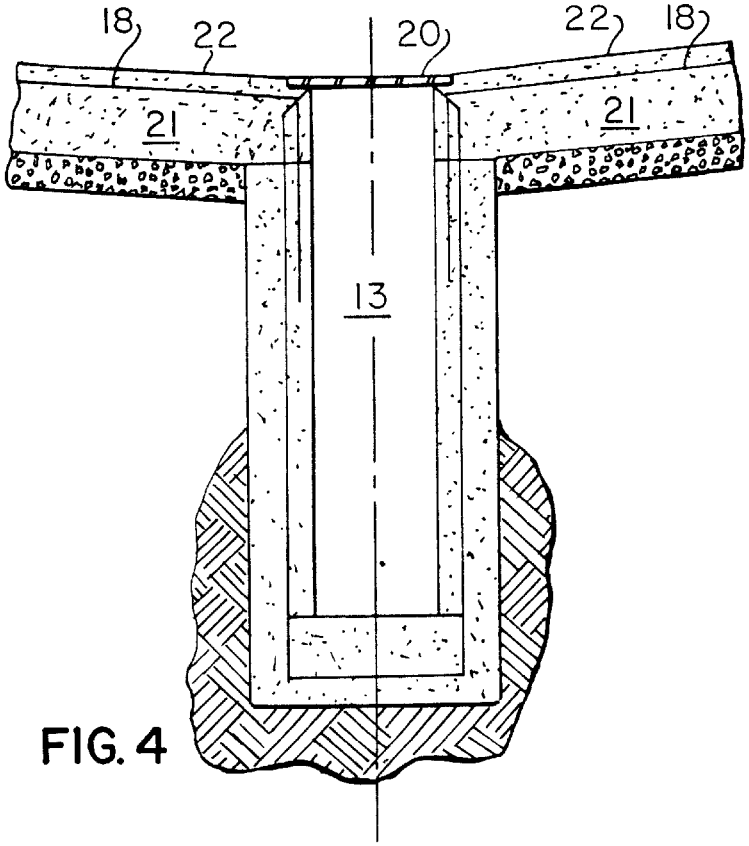
FIG. 4 is a cross-sectional view of one of the drainage channels in the drying enclosure taken at 4—4.

FIGS. 2–4 depict cross-sectional views of the drainage channels 13 at three separate locations between the shallow end and the deep end of channel 13. The cross-sections represent locations along lines 3—3, and 4—4, as shown on FIG. 1. The drainage water from the ash collects in the channel 13 and flows by gravity from above the level-of section 2—2 down through level 3—3, and on to level 4—4 as shown on FIG. 1 and there is emptied into collection channel 14 which is itself inclined downwardly to covered storage basin 15. Insofar as this process is concerned the water in the covered storage basin 15 is available for treatment and recycle in any suitable manner; since it is not needed for the process of this invention.

Figure 6:
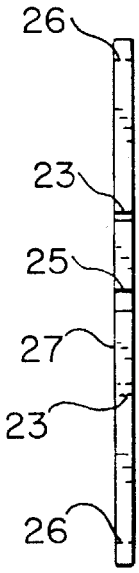
FIG. 6 is an enlarged end elevational view of the drainage channel cover of FIG. 5.
Figure 5:
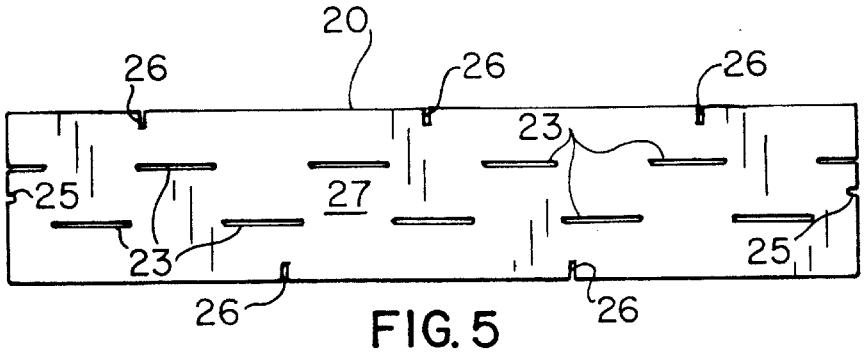
FIG. 5 is a top plan view of a drainage channel cover.

FIGS. 5–6 are views of the drainage channel plates or cover 20 that covers channel 13. Cover 20 is a steel plate of sufficient strength to allow equipment to cross over it without breaking. Generally, cover 20 is a sheet, for example, of T-1 steel, having a thickness of about 0.375 inch pierced with drainage slots 23 that are approximately 0.250 inch wide by about 6.0 inches long. Slots 25 are merely for removing and replacing channel covers 20 when needed for maintenance operations. The other slots 26 are about 0.25 inch by 2.0 inches in length and extend in the perpendicular direction with respect to slots 23 as shown in FIG. 6 so that water along the edges of the plate 20, which are supported on the side walls of the channel 13, may seep therethrough. The size and shape of the slots in covers 20 are intended to prevent, or at least minimize, the plugging of drainage channels 13 by clumps of ash that might fall into channels 13 and therefore require frequent cleaning, for example.

In addition to the drainage of water into channels 13, the piles of ash are subjected to dehumidified air inside the building shown in FIG. 1. Large volumes of dry warm air produced by dehumidifiers 24 are circulated over the drying combustion ash piles located in rows above surfaces 18 hasten the drying of the ash to a maximum level of about 28% moisture. This considerably shortens the treatment time from a couple of months to a couple of weeks, making the recycled use of municipal waste combuster ash into acceptable and economical products after processing and minimize placing same in landfills, and the like. Moisture-laden air is exhausted through fans 29 in the roof of the drying building 10 while dry air is blown into the building 10 from the dehumidifiers 24.

The dried ash made by the process of this invention is admirably suited to be the starting material for the process of aforementioned U.S. Pat. No. 5,992,776 issued Nov. 30, 1999.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States of America is:

1. An enclosed drainage facility for drying municipal waste combustion ash having a high moisture content and recovering that waste combustion ash with a low moisture content, said drainage facility comprising a floor, a roof and a plurality of walls forming an enclosed space, a plurality of spaced parallel drainage channels beneath said floor, a plurality of elongated perforated covers closing said channels and forming a part of said floor upon which is deposited piles of waste combustion ash to be dried, each said channel sloping toward a common collection trough that drains into a covered storage basin, said floor and channels being constructed of concrete and adapted and arranged to direct drainage water from piles of combustion ash through said perforated covers into said channels and said trough to said basin.

2. The facility of claim 1 further comprising dehumidifying means located adjacent one of said walls for providing dehumidified air into said facility.

3. The facility of claim 2 further comprising vent means located in said roof generally adjacent another said wall opposite to said one wall.

4. The facility of claim 3 wherein said vent means includes a fan to assist in drawing the dehumidified air across piles of ash in said facility and exhausting humid air from said facility.

5. The facility of claim 1 wherein said covers are perforated with a plurality of spaced long narrow slits extending generally parallel to longitudinal axes of said covers.

6. The facility of claim 5 wherein said covers include a plurality of spaced long narrow edge slits which extend generally perpendicular to said slits.

7. The facility of claim 1 wherein said floor includes sloping portions leading toward said channels.

8. The facility of claim 1 wherein said floor includes sloping portions leading toward each said channel.

9. The facility of claim 1 wherein said covers butt against each other along and entirely covering respective said channel for forming a substantially flat portion of said floor.

10. The facility of claim 9 wherein said floor includes downwardly sloping portions toward and generally terminating along each elongated side of each said cover.

11. A process for dewatering municipal waste combustion ash having a high moisture content which comprises piling municipal waste combustion ash having a moisture content of at least 35% within an enclosed facility having a floor with a plurality of spaced concrete underground drainage channels with porous metal plates covering the channels and a part of the floor and allowing water to drain from the combustion ash piles through the plates and the channels and be collected, dehumidifying the atmosphere within the facility to hasten the dewatering, and recovering ash with a moisture content of not more than 28% within about two weeks time.

12. The process of claim 11 wherein the concrete channels slope lengthwise to empty drained water into a common collection through and then into a covered basin to be further processed.

13. The process of claim 12 wherein the metal plates are steel pierced with a plurality of long slender slots about 0.25 inch wide by about 6.0 inches long.

14. The process of claim 11 wherein the atmosphere within the facility is warmed to about 80°–120° F. during the dehumidifying step.

15. The process of claim 14 wherein the atmosphere within the facility is vented to remove humid air from the facility.

16. The process of claim 11 wherein dehumidifying of the atmosphere within the facility is located adjacent one side of the facility and the atmosphere is exhausted therefrom adjacent an opposite side of the facility.

17. The process of claim 16 wherein the atmosphere within the facility is warmed to about 80°–120° F. during the dehumidifying step.

18. The process of claim 11 wherein the atmosphere within the facility is vented to remove humid air from the facility.

19. The process of claim 11 wherein the plates abut each other to substantially cover each channel and form a generally horizontal portion of the floor, the concrete floor between a pair of adjacent channels being sloped toward each adjacent channel to permit drainage of the piles of ash deposited on the concrete floor to drain toward each of the adjacent channels.

20. The process of claim 19 wherein dehumidifying of the atmosphere within the facility is located adjacent one side of the facility and the atmosphere is exhausted therefrom adjacent an opposite side of the facility, and wherein the atmosphere within the facility is warmed to about 80°–120° F. during the dehumidifying step.

* * * * *